US007357470B2

(12) United States Patent
Huang et al.

(10) Patent No.: US 7,357,470 B2
(45) Date of Patent: Apr. 15, 2008

(54) APPARATUS AND METHOD FOR CONTROLLING PRINTING TIME

(75) Inventors: Chien-Chih Huang, Taoyuan (TW); Chun-Jen Lee, Taoyuan (TW)

(73) Assignee: Qisda Corporation, Gueishan, Taoyuan (TW)

( * ) Notice: Subject to any disclaimer, the term of this patent is extended or adjusted under 35 U.S.C. 154(b) by 322 days.

(21) Appl. No.: 11/191,511

(22) Filed: Jul. 28, 2005

(65) Prior Publication Data

US 2006/0023025 A1 Feb. 2, 2006

(30) Foreign Application Priority Data

Jul. 30, 2004 (TW) ..... 93123026 A

(51) Int. Cl.
*B41J 29/38* (2006.01)
*B41J 23/00* (2006.01)

(52) U.S. Cl. ..... 347/5; 347/37

(58) Field of Classification Search ..... 347/5, 347/19, 37

See application file for complete search history.

(56) References Cited

U.S. PATENT DOCUMENTS 6,350,073 B1 * 2/2002 McCue et al. ..... 400/582
6,419,338 B1 * 7/2002 Ikeda ..... 347/14
6,854,905 B2 * 2/2005 Hardisty et al. ..... 400/323

FOREIGN PATENT DOCUMENTS

JP 11334149 12/1999

* cited by examiner

*Primary Examiner*—Julian D. Huffman
*Assistant Examiner*—Jason S Uhlenhake
(74) *Attorney, Agent, or Firm*—Hoffman, Warnick & D'Alessandro LLC

(57) ABSTRACT

The invention provides a printing control system for controlling a print-head. The printing control system includes a motor controller, a time-delaying generator coupled to the motor controller, and a timer coupled to the delay time generator. The motor controller is used for calculating the moving speed of the print-head reaching a printing position. The time-delaying generator is used for generating a delay time according to the moving speed. The timer is used for starting to count a printing time after the print-head reaches the printing position. When the printing time equals the delay time, the timer outputs a printing signal to control the print-head to jet out an ink drop.

9 Claims, 6 Drawing Sheets

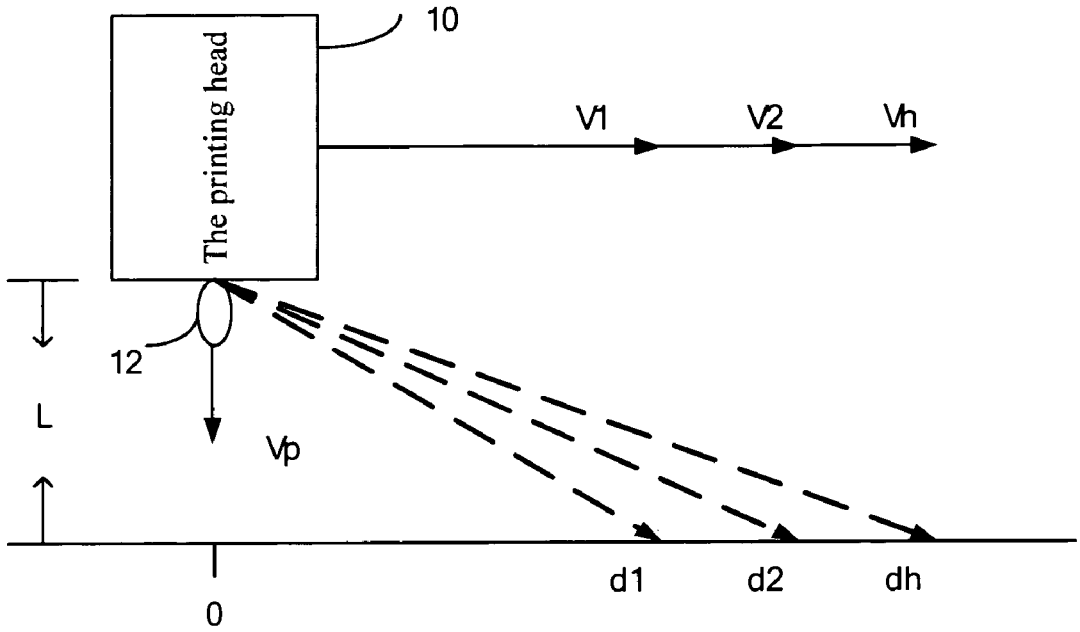
FIG. 1 The prior art
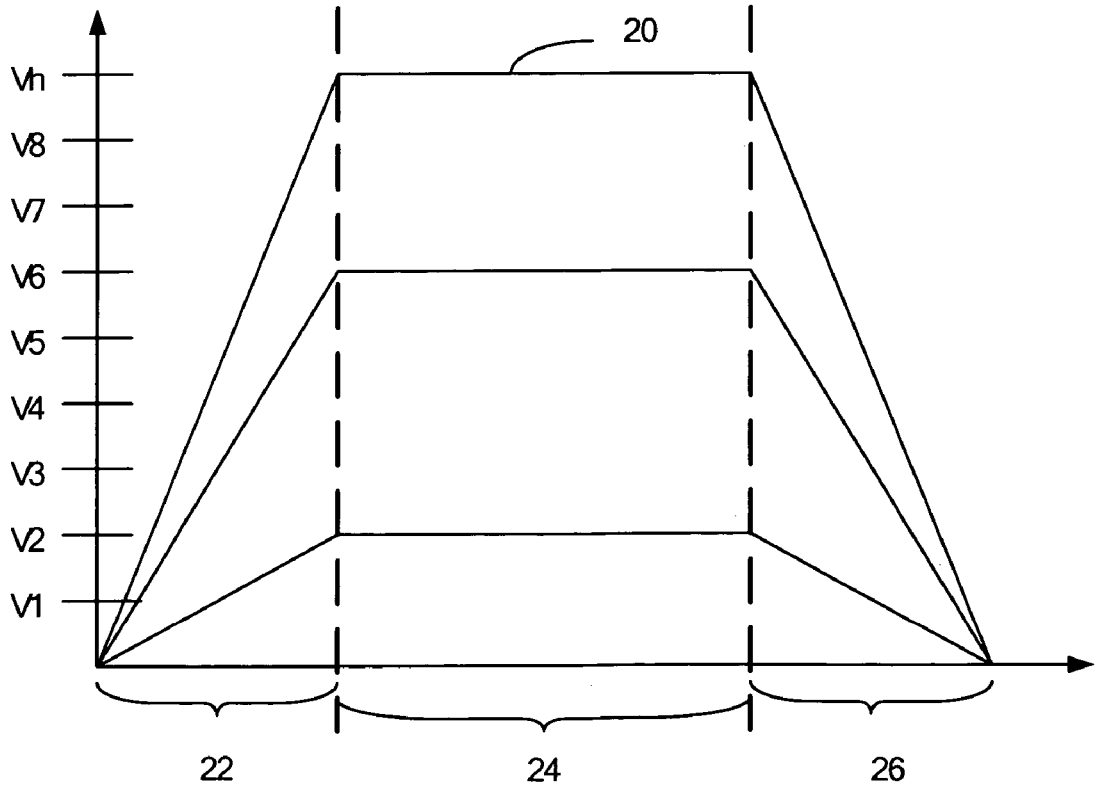
FIG. 2 The prior art

APPARATUS AND METHOD FOR CONTROLLING PRINTING TIME

BACKGROUND OF THE INVENTION

1. Field of the Invention

This present invention relates to a printing control system for controlling the time of a print-head to jet out an ink drop at different moving speeds.

2. Description of the Prior Art

The well-known print-head of the printing apparatus is driven by a motor to move back and forth. The print-head will go through a moving process of accelerating, uniform speed, and decelerating during the printing process. Because a certain distance exists between the print-head and the printing paper, when the print-head jets out an ink drop at different moving speeds, the position on the paper where the ink drop lands will also be different. If the print-head continues to jet out ink drops while the moving speed is being changed, the print quality will be affected by unbalanced ink density. Therefore, the printing margin of the printing apparatus of prior art is set corresponding to the moving speed of the print-head, so as to avoid the shifting of the landing positions of ink drops while the moving speed of the print-head is being changed.

Please refer to FIG. 1. FIG. 1 is a schematic diagram of relative landing positions of an ink drop when the print-head 10 of the prior art jets out an ink drop 12 at different moving speeds. In FIG. 1, V1, V2, and Vh respectively represent different moving speeds; d1, d2, and dh respectively represent different positions where the ink drop 12 lands corresponding to V1, V2, and Vh, and Vp represents the jetting speed of the ink drop 12 which is jetted out by the print-head 10; L represents the distance between the print-head 10 and the printing paper. The position that the ink drop 12 is jetted out by the print-head 10 is set to be 0 which also changes according to different jetting speeds. The faster the moving speed, the longer the distance between the landing position of the ink drop 12 and the position 0.

Please refer to FIG. 2. FIG. 2 is a diagram about the relationship between the printing time and the moving speed of the print-head 10 in FIG. 1. In FIG. 2, the x-axis represents the printing time, and the y-axis represents the moving speed of the print-head 10. When the print-head is started to print, it will go through the moving process of accelerating, uniform speed, and decelerating; for example, the speed curve 20 of FIG. 2 includes an accelerating interval 22, a uniform speed interval 24, and a decelerating interval 26. In order to avoid the situation where unbalanced ink density affects the printing quality because the ink drop 12 jetted out by the print-head 10 lands at different positions corresponding to different moving speed, the printer can set the printing margin to be in the uniform speed interval 24. When printing in different number of dots per inch, the moving speed of the print-head 10 changes accordingly; therefore, different speed curves are generated. When the print-head 10 is set to print in the certain designated number of dots per inch, the moving speed of the print-head is Vh (the speed at the uniform speed interval).

Printers disclosed in the prior art increases the printing margin by increasing the length of the uniform speed interval 24 and decreasing the length of the accelerating interval 22 and the decelerating interval 26. However, the moving distance of the print-head 10 is restricted to the size of the printer's body, and the degree of increasing the length of the uniform speed interval 24 and decreasing the length of the accelerating interval 22 and the decelerating interval 26 is also confined to a certain extent. Therefore, upon the trend of miniaturizing printers, the method of increasing the length of the uniform speed interval 24 and decreasing the length of the accelerating interval 22 and the decelerating interval 26 has limitations.

In order to solve the above-mentioned problems, the present invention provides a printing control system and method thereof to improve printing quality while the print-head moves at different moving speeds and to further increase the printing margin.

SUMMARY OF THE INVENTION

One scope of the present invention is to provide a printing control system and the method thereof for controlling the time an ink drop which is jetted out by the print-head at different moving speeds to keep the same printing quality while the print-head moves at different moving speeds and for further increasing the printing margin.

The printing control method of the present invention includes the following steps. First, a motor controller is used to calculate a moving speed of the print-head reaching a printing position. Next, a time-delaying generator, coupled to the motor controller, is used for generating a delay time according to the moving speed. Also, a timer, coupled to the time-delaying generator, is used for starting to calculate the printing time after the print-head reaches the printing position. A printing signal is outputted to control the print-head to jet out an ink drop when the printing time equals the delay time.

The printing control system and method thereof of the present invention can control the time of the print-head jetting out an ink drop at different moving speeds, which makes the ink drop jetted out by the print-head land at the predicted position, so as to improve the printing quality when the print-head moves at different moving speeds and to further increase the printing margin.

The advantage and spirit of the invention may be understood by the following recitations together with the appended drawings.

BRIEF DESCRIPTION OF THE APPENDED DRAWINGS

FIG. 1 is a schematic diagram of relative landing positions of an ink drop when the print-head jets out an ink drop at different moving speeds.

FIG. 2 is a diagram about the relationship between the printing time and the moving speed of the print-head in FIG. 1.

DETAILED DESCRIPTION OF THE INVENTION

Figure 3:
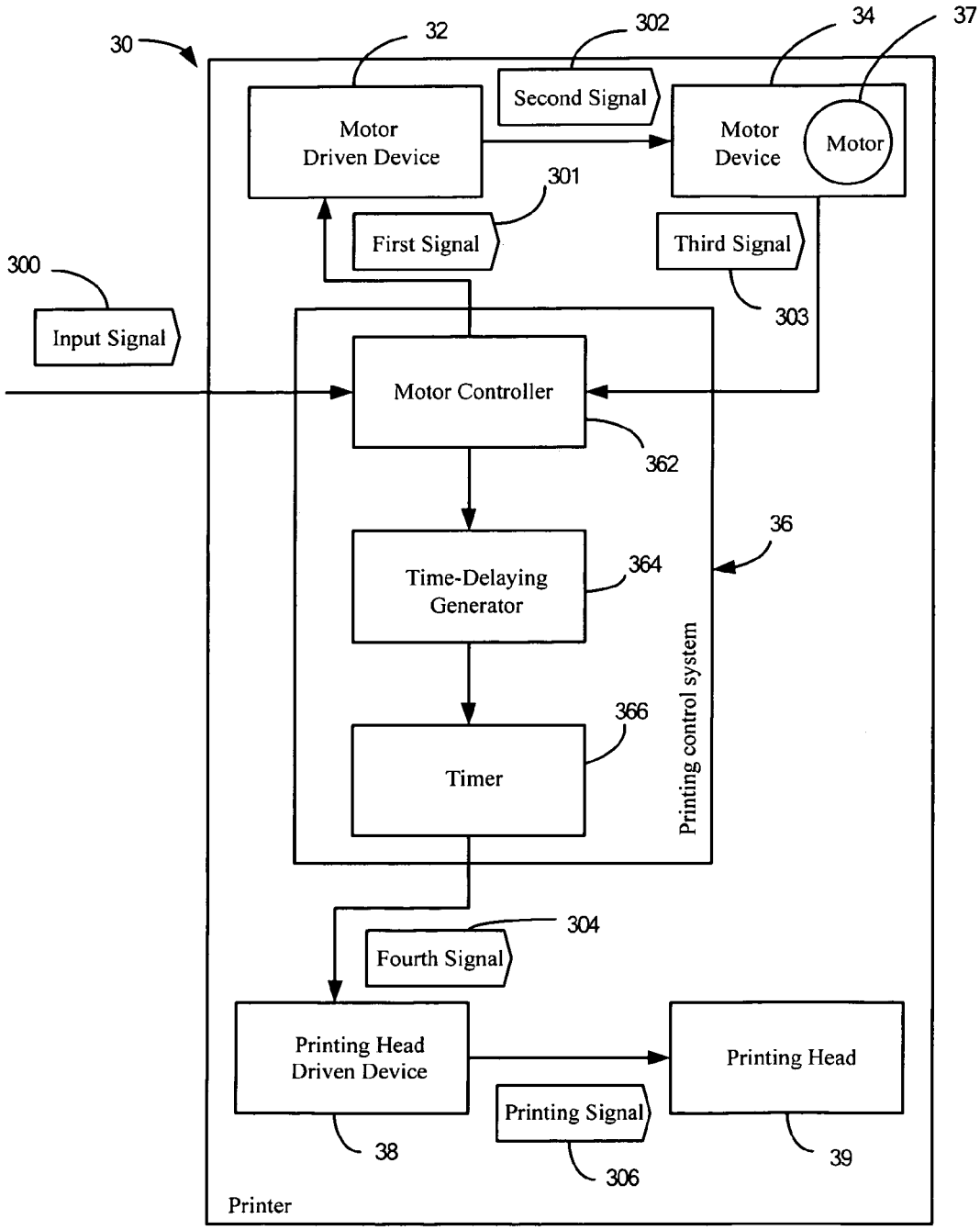
FIG. 3 is a systematic block diagram of the printer with the application of the printing control system of the present invention.

Referring to FIG. 3, FIG. 3 is a systematic block diagram of the printer 30 with the application of the printing control system 36 of the present invention. In an embodiment, the printing control system 36 according to the present invention is applied in the printer 30; the printing control system 36 is used to control a print-head 39. The printer 30 includes a motor driven device 32, a motor device 34, the printing control system 36, a print-head driven device 38, and a print-head 39. The motor device 34 includes a motor 37 and an encoder (not shown). The motor 37 can be a direct-current motor. The motor driven device 32 outputs a second signal 302 to the motor device 34 according to a first signal 301. The motor 37 of the motor device 34 receives the second signal 302 to drive the print-head 39 to move correspondingly, and the encoder of the motor device 34 outputs a third signal 303 to the printing control system 36 according to the moving position of the print-head 39.

The printing control system 36 of the present invention includes a motor controller 362, a time-delaying generator 364 coupled to the motor controller 362, and a timer 366 coupled to the time-delaying generator 364. The motor controller 362 makes the print-head 39 move back and forth by controlling the rotation of the motor 37. The motor controller 362 is used to calculate the moving speed when the print-head 39 reaches a printing position. The motor controller 362 receives an inputting signal 300 and correspondingly outputs the first signal 301 to the motor driven device 32, and it also calculates the moving speed of the print-head 39 when the print-head 39 reaches a printing position according to the third signal 303 received from the motor device 34. The time-delaying generator 364 is used to generate a delay time according to the moving speed. The timer 366 is used to start calculating the printing time after the print-head 39 reaches the printing position. When the printing time equals the delay-time, the timer 366 outputs a fourth signal 304 to the print-head driven device 38. The print-head driven device 38 receives the fourth signal 304 and outputs an ink-jetting signal 306 to the print-head 39 to control the print-head 39 to jet out an ink drop (not shown).

The time-delaying generator 364 generates the delay-time by calculating through a formula. In an embodiment, the time-delaying generator 364 includes an arithmetic logic unit (ALU) for generating the delay time according to a predetermined rule. Based on the moving speed calculated by the motor controller 362, the time-delaying generator 364 makes use of ALU to calculate the corresponding delay time according to the predetermined rule.

The following will take a schematic diagram of the relative landing positions of the ink drop 12 which is jetted out by the print-head 10 at different moving speed in FIG. 1 as an example to illustrate how the time-delaying generator 364 generates the delay time according to the predetermined rule. In FIG. 1, V1, V2, and Vh respectively represent different moving speeds; d1, d2, and dh respectively represent relative different positions where the ink drop 12 lands, corresponding to different moving speeds V1, V2 and Vh; Vp represents the jetting speed of the ink drop 12 when the ink drop 12 is jetted out by the print-head 10; L represents the distance between the print-head 10 and the printing paper, wherein the position that the ink drop 12 is jetted out by the print-head 10 is set to be 0. If the jetting speed of the ink drop 12 is constant, d1 is $$\frac{L}{V_p} \times V_1,$$

and the distance between dh and d1 is $$\frac{L}{V_p}(V_h - V_1),$$

which are calculated from the relative positions in FIG. 1. In other words, the relative landing positions will result in a shift of $$\frac{L}{V_p}(V_h - V_1)$$

when the ink drop 12 is jetted out at the moving speed V1 and Vp. In order to compensate the shift and make the two ink drops 12 land at the same position, there must be a delay time of $$\frac{L}{V_p}\left(\frac{V_h}{V_1} - 1\right)$$

when the ink drop 12 is jetted out at d1 position. It is based on assumption that the maximum operational moving speed of the print-head 10 is Vh, dh represents the corresponding landing position, and Vx represents the moving speed of the print-head 10 when the print-head 10 reaches the printing position; the print-head needs the delay time of $$\frac{L}{V_p}\left(\frac{V_h}{V_x} - 1\right)$$

in order that the relative landing positions of the ink drop 12 is the same at each moving speed Vx. As mentioned above, the predetermined rule of the time-delaying generator 364 is $$T_d = \frac{L}{V_p}\left(\frac{V_h}{V_x} - 1\right),$$

where Td represents the delay time.

Figure 4B:
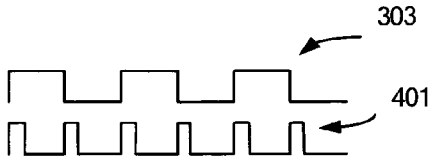
FIG. 4B is a schematic diagram of the third signal and a pulse signal in FIG. 4A.
Figure 4A:
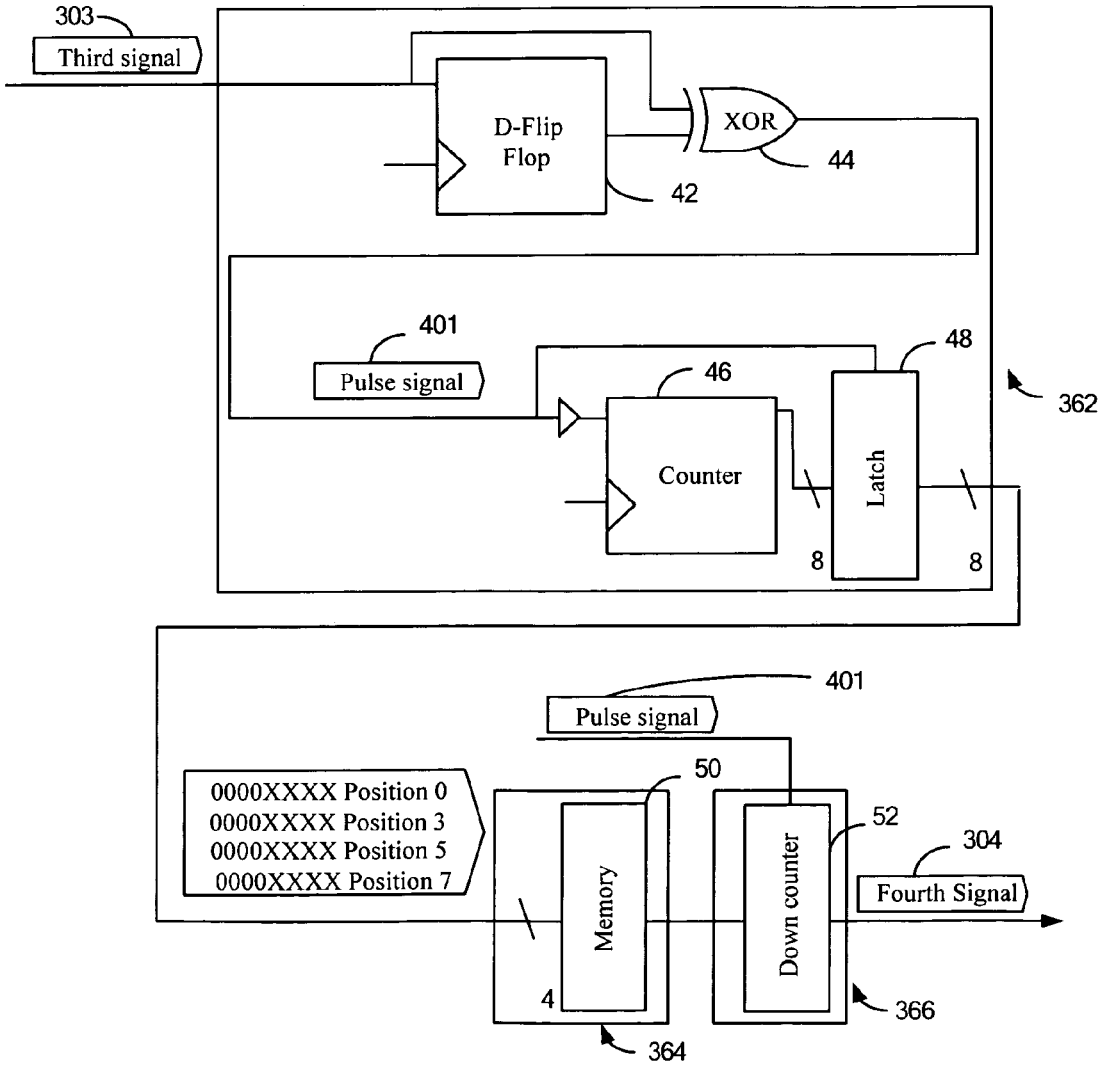
FIG. 4A is a circuit diagram of one embodiment of the printing control system in FIG. 3.

The time-delaying generator 364 can also generate the delay time by pre-storing a plurality of predetermined delay time in a memory. In another embodiment, the time-delaying generator 364 includes a memory (not shown). The memory pre-stores a plurality of delay time corresponding to different moving speeds, and the time-delaying generator 364 searches corresponding delay time in the memory according to the moving speed at that time. Please refer to FIG. 4A and FIG. 4B. FIG. 4A is a circuit diagram of one embodiment of the printing control system 36 in FIG. 3, and FIG. 4B is a schematic diagram of the third signal 303 and a pulse signal 401 in FIG. 4A. In an embodiment of FIG. 4A, the motor controller 362 includes a D-Flip Flop 42, a XOR 44, a 8-bits counter 46, and a Latch 48. The time-delaying generator 364 includes a memory 50, which pre-stores a plurality of delay time corresponding to moving speeds, and functions by pre-storing them in the memory.

In a motor controller 362 as illustrated in FIG. 4A, the third signal 303 outputted by the encoder of the motor device 32 passes through the D-Flip Flop 42 and the XOR 44 to generate the pulse signal 401. The pulse signal 401 is a one-shot signal and acts as a position marker for the print-head 39 and as a signal for calculating the moving speed. When the print-head 39 moves, the timer 46 starts to count the time which is needed by two pulses of the pulse signal 401 so that the moving speed of the print-head 39 can be calculated. When the value of the pulse signal is high, the latch 48 will retain the counted value, and the counter 46 resets itself to 0 to recount.

Whenever the value of the pulse signal 401 is high, the latch will retain the counted value and will take the first four bytes as the reading position of the memory 50. In this embodiment, the memory 50 of the time-delaying generator 364 pre-stores 16 sets of delay time corresponding to the different moving spends of the print-head. For example, if the counted value is 00000000~00001111, that represents the print-head 39 moving at the fastest speed; the first four bytes are taken at this time, and its corresponding position is 0. Therefore, the information about the delay time at position as 0 is taken from the memory 50 and is set as the delay time which is needed by the print-head 39 at that moving speed, and other calculated values are processed in similar ways. If more accurate delay time is desired, more sets of information about the delay time can be stored in the memory 50.

The timer 366 includes a down counter 52. Whenever the value of the pulse signal 401 is high, the down counter 52 loads the necessary delay time and then counts downward. When it counts down to 0, the fourth signal 304 is outputted to the print-head driving apparatus 38 to drive the print-head 39 to print.

Figure 5:
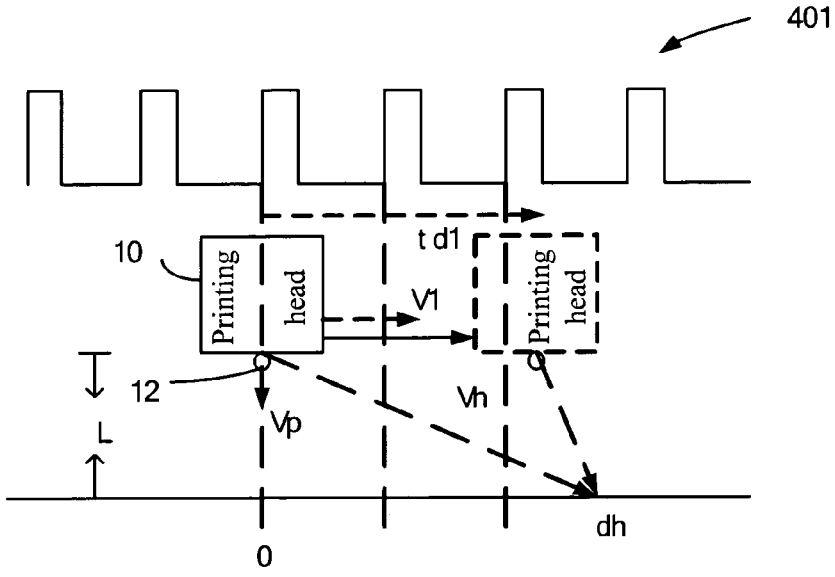
FIG. 5 is a diagram about the relationship between the time of the ink drop jetting out and the moving speed.

Please refer to FIG. 5; FIG. 5 is a diagram about the relationship between the time of the ink drop 12 jetting out and the moving speed. As mentioned above, the time-delaying generator 364 generates the corresponding delay time according to the moving speed of the print-head 10 in the condition of the pulse signal 401 being high). The maximum moving speed of the print-head 10 is Vh, and at the same time, the ink drop 12 lands correspondingly at position dh. If the print-head 10 moves at the slower moving speed V1, the time that has to be delayed is td1; in other words, the print-head 10 needs to move to the dotted line when the ink drop 12 is jetted out, so the ink drop will land at the same relative position dh. However, two delay times have been generated in the term of the delay time in FIG. 5. In such circumstance, a plurality of timers can be further utilized, wherein the number of timers can be decided by known parameters L, Vp, Vh, and printing position length d of previously mentioned printer, and $$d_h = \frac{L}{V_p} \times V_h;$$

the number of timers needed is n if $(n-1)\times d \leqq d_h \leqq n\times d$.

Figure 6:
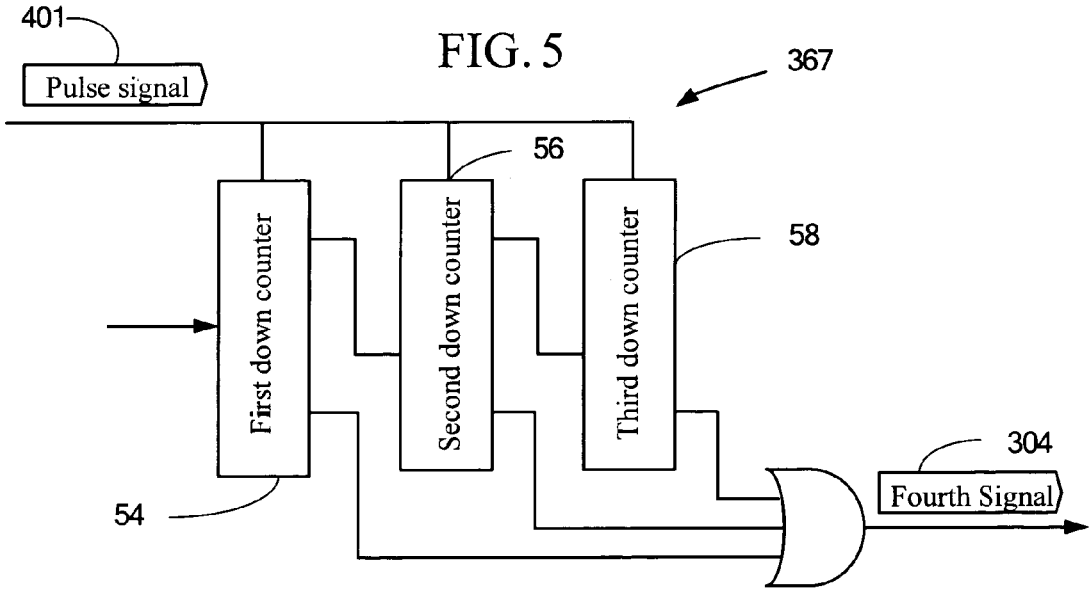
FIG. 6 is a circuit diagram of the timer of another embodiment of the printing control system in FIG. 4A.

Please refer to FIG. 6; FIG. 6 is a circuit diagram of the timer 367 of another embodiment of the printing control system 36 in FIG. 4A. Comparing timer 367 in FIG. 6 with the timer 366 in FIG. 4A, the timer 367 in FIG. 6 includes three downward counters: the first down counter 54, the second down counter 56, and the third down counter 58. When the value of the first pulse signal 401 is high, the time-delaying generator 364 (not shown in FIG. 6) generates a corresponding first delay time according to the moving speed of the print-head 39 at the time, and the first down counter 54 immediately loads the first delay time to count down. When the value of the second pulse signal 401 is high, the time-delaying generator 364 generates a corresponding second delay time. If the first down counter 54 still has not count to 0 yet at this time, the counted value will be loaded into the second down counter 56, and the second delay time will be loaded into the first down counter 54; then, both will continue to count down. When the value of the third pulse signal 401 is high, the time-delaying generator 364 generates a corresponding third delay time. If the first down counter 54 and the second down counter 56 both have not count to 0 yet at this time, the counted value is loaded into the next counter, and the third delay time is loaded into the first down counter 54; then, all will continue to count down. When the loaded value of the timer is 0, no more counting down will be done, and a fourth signal 304 will be outputted to the print-head driven device 38 (not shown in FIG. 6) to drive the print-head 39 to print.

Figure 7:
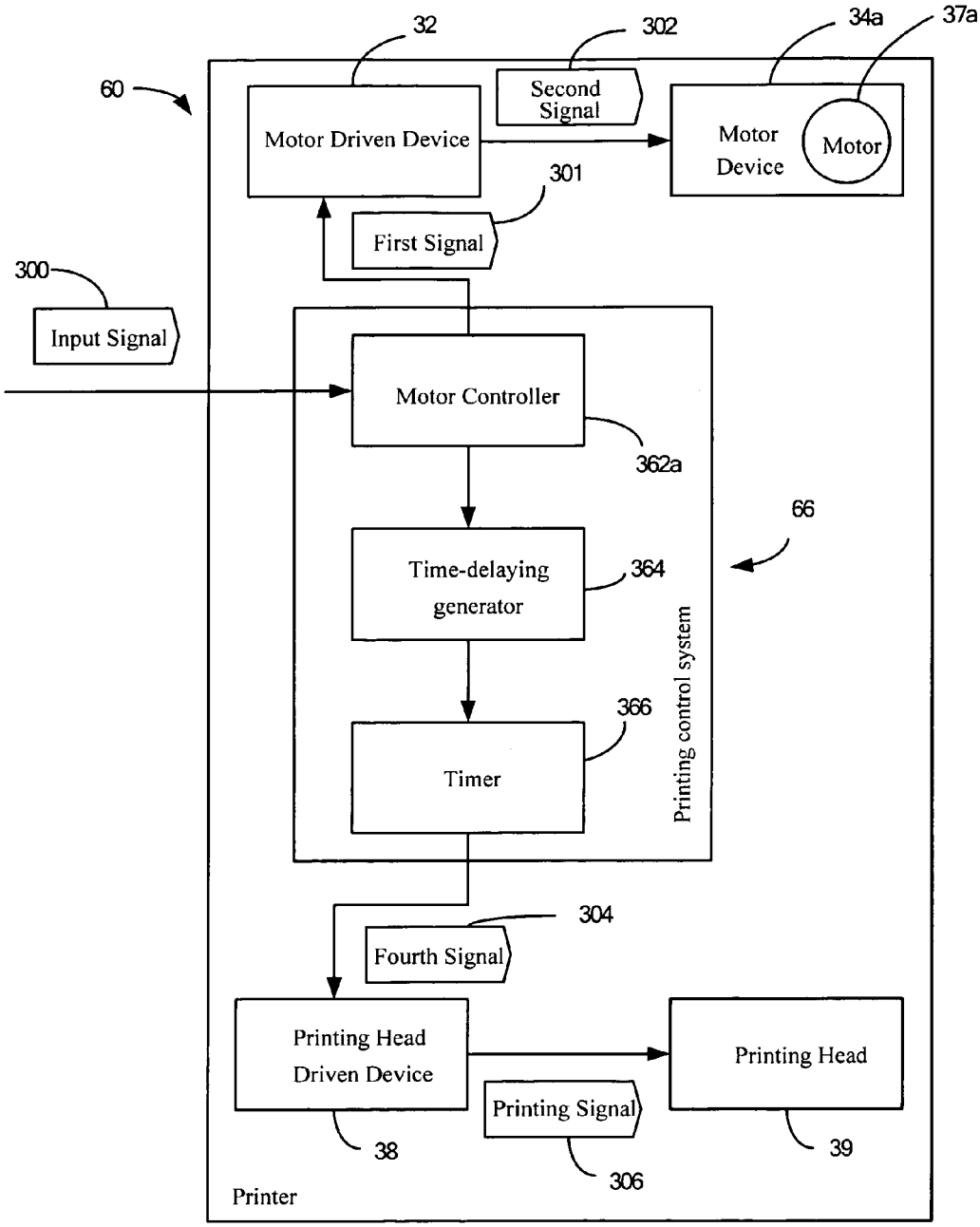
FIG. 7 is a schematic diagram of another embodiment of the printer with the application of the printing control system of the present invention.

Please refer to FIG. 7; FIG. 7 is a schematic diagram of another embodiment of the printer 60 with the application of the printing control system 66 of the present invention. The difference between the printer 60 in FIG. 7 and the printer 30 in FIG. 2 is the motor device and motor controller. The motor 37 of the motor device 34 in the printer 30 is a direct-current motor, and the motor controller 362 of the printing control system 36 is a corresponding direct-current motor controller. The motor 37*a* of the motor device 34*a* in the printer 60 is a stepper motor, and the motor controller 362*a* of the printing control system 66 is a corresponding stepper motor; the motor controller 362*a* is used for deciding the moving position and the moving speed of the print-head 39. Because the moving distance per unit of the stepper motor 37*a* is fixed, the moving speed of the print-head 39 at that time can be obtained by controlling the length of time interval between each moving distance per unit; thus, in this embodiment, the motor device 64 does not need to send the third signal to the motor controller 362*a*. As for the other elements in the printer 60, they are the same as the embodiment of FIG. 3, and the function method is the same, so it will not be described in detail again.

Figure 8:
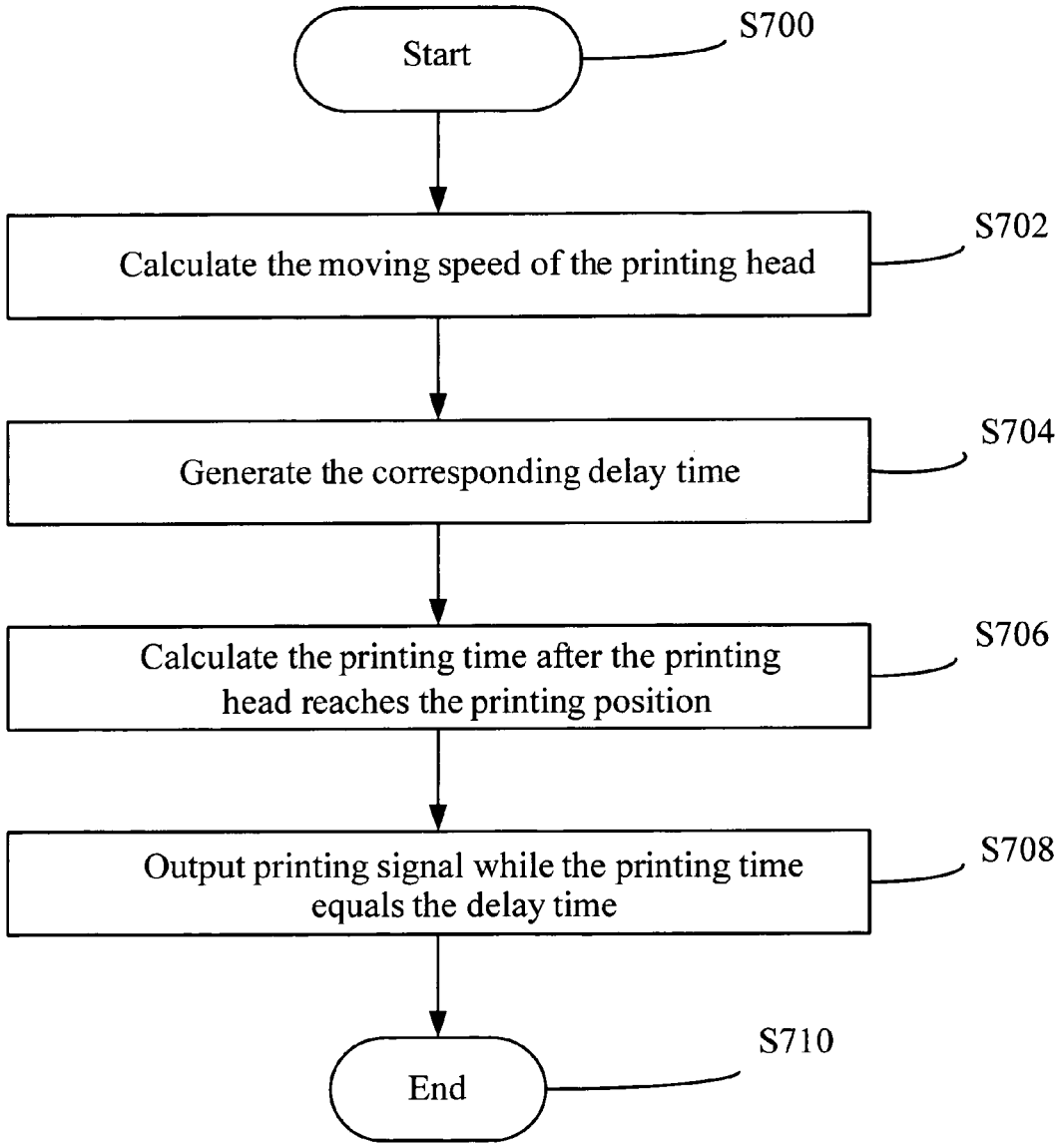
FIG. 8 is a flowchart of the printing control method of the present invention.

Referring to FIG. 8, FIG. 8 is a flowchart of the printing control method of the present invention. The printing control method includes the following steps:

- S700: Start;
- S702: Calculate the moving speed of the print-head when it reaches a printing position;
- S704: Generate the delay time according to the moving speed;
- S706: Start to calculate the printing time after the print-head reaches the printing position; and
- S708: Output the printing signal to control the print-head to jet out an ink drop when the printing time equals the delay time;
- S710: End.

The printing control method of the present invention is used for controlling the print-head, and it can be applied in a direct-current motor or a stepper motor to make the print-head move back and forth.

In an embodiment, the method of the step of S704 to generate the delay time can be selected from the memory which pre-stores the information of delay time corresponding to a plurality of moving speeds. In another embodiment, the method to generate a delay time accords to a predetermined rule, wherein the rule is $$T_d = \frac{L}{V_p}\left(\frac{V_h}{V_x} - 1\right).$$

In the formula, Td represents the delay time; L represents the distance between the print-head and the print paper; Vp represents the jetting speed of the ink drop; Vh represents the maximum operational moving speed, and Vx represents the moving speed after the print-head reaches the printing position.

The printing control system and method of the present invention can control the printing time of the print-head, so as to make an ink drop which is jetted out by the print-head at different speeds land at the predicted position; therefore, the printing quality can be improved when the print-head moves at different moving speeds. In the application of the printing control system and the method of the printer of the present invention, the printing quality can be enhanced when the print-head moves at different moving speed, so that the printing margin can be increased. With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A printing control system for controlling a print-head, comprising:

a motor controller for calculating a moving speed of the print-head upon reaching a predetermined printing position;

a time-delaying generator, coupled to the motor controller, comprising an arithmetic logic unit (ALU) for generating a delay time according to a predetermined rule described by the following formula:

$$T_d = \frac{L}{V_p}\left(\frac{V_h}{V_x} - 1\right),$$

where $T_d$ represents the delay time, L represents the distance between the print-head and a printing paper, $V_p$ represents a jetting speed of the ink, $V_h$ represents the maximum moving speed of the print-head, and $V_x$ represents the moving speed that the print-head reaches at the predetermined printing position; and a timer, coupled to the time-delaying generator, for starting to calculate a printing time after the print-head reaches the predetermined printing position and outputting a printing signal to control the print-head to jet out an ink drop when the printing time equals the delay time.

2. The printing control system of claim 1, wherein the time-delaying generator comprises a memory for storing a plurality of delay times corresponding to a plurality of predetermined moving speeds.

3. The printing control system of claim 1, wherein the motor controller makes the print-head move back and forth by controlling a rotation of a motor.

4. The printing control system of claim 3, wherein the motor is a direct-current motor.

5. The printing control system of claim 3, wherein the motor is a stepper motor.

6. A printing control method for controlling a print-head, said method comprising:

calculating a moving speed of the print-head upon reaching a predetermined printing position;

generating a delay time according to a predetermined rule described by the following formula:

$$T_d = \frac{L}{V_p}\left(\frac{V_h}{V_x} - 1\right),$$

where $T_d$ represents the delay time, L represents the distance between the print-head and a printing paper, $V_p$ represents a jetting speed of the ink, $V_h$ represents the maximum moving speed of the print-head, and $V_x$ represents the moving speed that the print-head reaches at the predetermined printing position;

starting to calculate a printing time after the print-head reaches the predetermined printing position; and outputting a printing signal to control the print-head to jet out an ink drop when the printing time equals the delay time.

7. The printing control method of claim 6, further comprising:

storing a plurality of delay times corresponding to a plurality of predetermined moving speeds.

8. The printing control method of claim 6, wherein a direct-current motor makes the print-head move back and forth.

9. The printing control method of claim 6, wherein a stepper motor makes the print-head move back and forth.

* * * * *